United States Patent [19]

Neal

[11] 4,091,893

[45] May 30, 1978

[54] LADDER HAVING ADJUSTABLE LEG EXTENSIONS

[76] Inventor: Loyd L. Neal, 329 S. Wheeling, Kansas City, Mo. 64123

[21] Appl. No.: 790,245

[22] Filed: Apr. 25, 1977

[51] Int. Cl.[2] ..... E06C 7/44

[52] U.S. Cl. ..... 182/204

[58] Field of Search ..... 182/204, 201, 205, 179

[56] References Cited

U.S. PATENT DOCUMENTS

| | | | |
|---|---|---|---|
| 317,024 | 5/1885 | Schumman | 182/178 |
| 2,152,895 | 4/1939 | Longtin | 182/205 |
| 3,394,774 | 7/1968 | Lanier | 182/204 |
| 3,861,500 | 1/1975 | Dempsey | 182/204 |

FOREIGN PATENT DOCUMENTS

| | | | |
|---|---|---|---|
| 44,660 | 10/1908 | Switzerland | 182/201 |

*Primary Examiner*—Reinaldo P. Machado

*Attorney, Agent, or Firm*—Lowe, Kokjer, Kircher, Wharton & Bowman

[57] ABSTRACT

A ladder has adjustable extensions which provide downward continuations of its legs. By securing the extensions in appropriate positions, the legs are provided with different effective lengths so that the ladder may be used safely on staircases and on other uneven or sloping terrain.

5 Claims, 6 Drawing Figures

LADDER HAVING ADJUSTABLE LEG EXTENSIONS

BACKGROUND AND SUMMARY OF THE INVENTION

This invention relates generally to ladders and more specifically to an improved ladder having extensions on the lower ends of its legs.

During the course of construction and repair work and perhaps even more commonly in painting, the need often arises to employ a ladder on stairs or on a sloping or uneven surface. For example, in painting walls or ceilings in the vicinity of staircases, the ladder must be placed on the stairs and braced against the adjacent wall. Typically, a block or stack of blocks is placed on the lower stair beneath one of the ladder legs in order to compensate for the different elevation of the stairs. Similar situations exist in painting or repairing an outside wall where the ground is sloping or uneven. Identical problems are also encountered wen ladders are used on top of slanted roofs, as well as in many other instances in which a ladder is used on an uneven or inclined surface.

As can be readily appreciated, the use of blocks and the like under a ladder leads to unsafe conditions and is often the cause of serious injury, particularly since it is not uncommon for books and other makeshift items to be employed as blocks. Consequently, a need exists for a ladder which is capable of standing uprightly on staircases and on other uneven or inclined surfaces. It is the primary goal of the present invention to meet that need.

More specifically, it is an object of the invention to provide a ladder having adjustable extensions for the lower ends of its legs by which the effective lengths of the ladder legs may be varied.

Another object of the invention is to provide a ladder having leg extensions which may be secured in a variety of positions so that the ladder may be used effectively on terrains having various degrees of inclination or unevenness.

Yet another object of the invention is to provide a ladder of the character described which has an extension for each leg, with each extension being adjustable independently.

A further object of the invention is to provide a ladder of the character described wherein the extensions may be securely locked in position to eliminate the possibility of inadvertent slippage.

An additional object of the invention is to provide a ladder of the character described in which the extensions may be quickly and easily moved between their extended and retracted positions, and quickly and easily secured in each position.

A still further object of the invention is to provide a ladder of the character described which is simple and economical to construct and yet structurally strong.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 1:
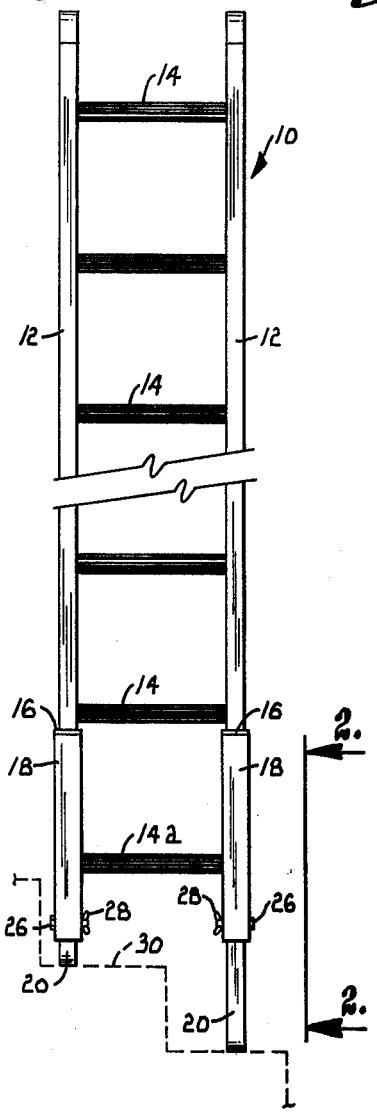
FIG. 1 is a front elevation view of a ladder constructed according to a first embodiment of the present invention as employed on a staircase, with the broken away portions indicating continuous length.
Figure 2:
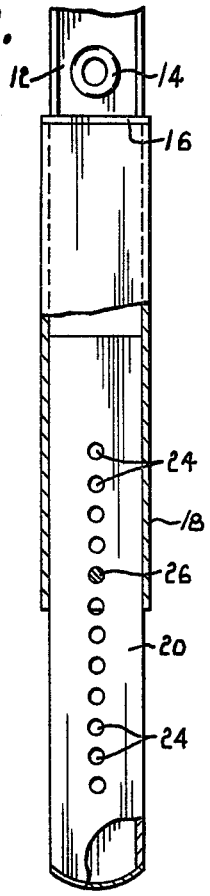
FIG. 2 is a fragmentary view on an enlarged scale taken generally along line 2—2 of FIG. 1 in the direction of the arrows, with portions broken away for illustrative purposes.
Figure 3:
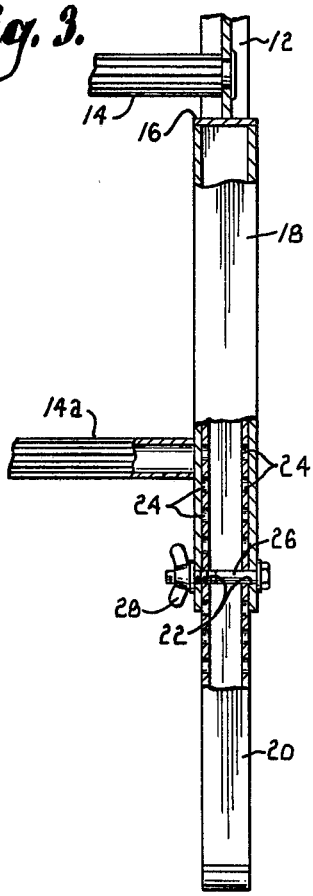
FIG. 3 is an enlarged fragmentary view of the lower portion of one of the ladder legs shown in FIG. 1, with portions broken away for illustrative purposes.

Referring now to the drawing in detail and initially to FIGS. 1-3, reference numeral 10 generally designates a ladder embodying the present invention. The ladder 10 includes a pair of elongate, rigid legs 12 which are spaced apart and parallel to one another. A plurality of horizontal rungs 14 are secured to extend rigidly between legs 12 at spaced locations along their lengths. The legs 12 and rungs 14 are preferably a lightweight metal such as aluminum, although they may be constructed of any suitable material possessing adequate strength. Legs 12 are preferably I-beams, while rungs 14 are cylindrical with a scored exterior surface for receiving the feet.

A small flat plate 16 is secured to the lower end of each leg 12. Extending downwardly from each plate 16 is a hollow metal tube 18 which is rectangular in section and which forms the lower portion of the corresponding leg. Each tube 18 is open at the bottom. The lowermost rung **14*a* of the ladder extends rigidly between tubes 18**.

Each leg has an extension 20 which serves as a downward continuation of the leg. As best shown in FIGS. 2 and 3, each extension 20 is a hollow metal member rectangular in section which fits closely yet slidably within its tube 18. Accordingly, each extension 20 is able to extend and retract in a manner to vary the effective length of its leg. The bottom of each extension 20 is smoothly curved so that the ladder may be leaned against a wall or another supporting surface.

Each tube 18 is provided with aligned openings 22 (FIG. 3) in its opposite sides. The extensions 20 are each provided with a series of vertically spaced openings 24 which are equal in size to openings 22. To secure each extension rigidly in place relative to its tube 18, a bolt 26 may be inserted through openings 22 and the extension opening 24 which is aligned therewith. A wing nut 28 may then be tightened on the bolt to lock the extension and tube together. The fit of each extension 20 in its tube 18 is preferably close enough that the extension is unable to pivot about the bolt axis to any appreciable extent.

In use, both extensions 20 are normally in their retracted positions as shown for the left extension 20 in FIG. 1. Both ladder legs then have the same effective length, and the ladder may be employed normally on a flat horizontal surface. However, when the ladder is to be employed on an uneven or sloping surface such as the staircase designated by numeral 30 in FIG. 1, one of the extensions 20 is moved to its extended position, as shown in FIG. 1 for the right extension. The extent to which the leg extension projects below the opposite extension depends upon the degree of unevenness or incline of the surface on which the ladder stands. For example, on staircase 30, the right extension is extended to a length sufficient for the ladder to stand in an upright position with the two extensions engaging adjacent stairs at their lower ends.

To move each extension between its extended and retracted positions, wing nut 28 and bolt 26 are removed, and the extension is slid inwardly or outwardly within tube 18 until the desired position is released. Bolt 26 is then reinserted through the aligned openings 22 and 24, and wing nut 28 is threaded onto the bolt to lock the extension 20 in the desired position. In this fashion, the two ladder legs may be provided with different effective lengths so that the ladder is capable of standing uprightly on virtually any type of surface.

Figure 5:
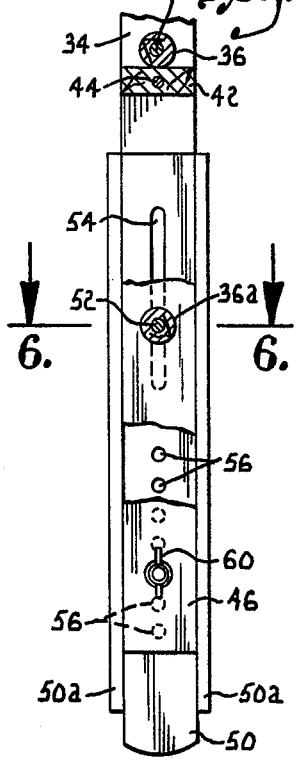
FIG. 5 is an enlarged fragmentary view taken partially in section generally along line 5—5 of FIG. 4 in the direction of the arrows, with portions broken away for illustrative purposes.
Figure 4:
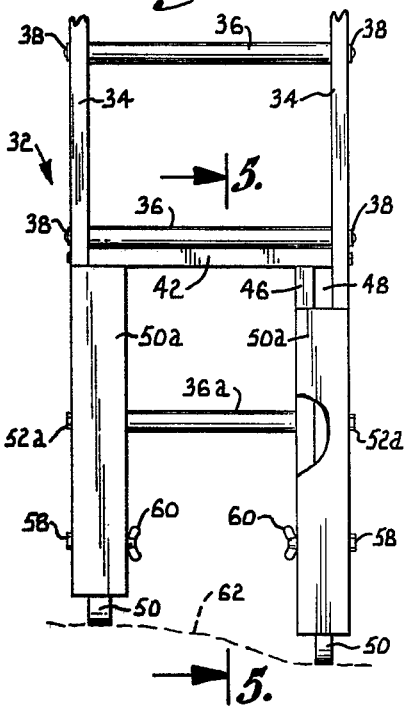
FIG. 4 is a fragmentary front elevational view illustrating the lower portion of a ladder constructed according to a second embodiment of the invention as employed on inclined terrain.
Figure 6:
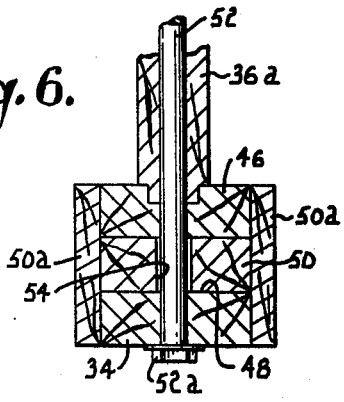
FIG. 6 is a fragmentary sectional view on an enlarged scale taken generally along line 6—6 of FIG. 5 in the direction of the arrows.

FIGS. 4–6 illustrate an alternative embodiment of the invention. Reference numeral 32 generally designates a ladder which is preferably constructed of wood for the most part. The ladder 32 includes a pair of wooden legs 34 which are spaced apart and parallel to one another. Wooden rungs 36 are secured to extend rigidly between legs 34 at selected locations along their lengths. Rungs 36 may be secured by conventional fasteners 38, and a wire rod 40 (FIG. 5) preferably extends axially through each rung for reinforcing purposes.

A cross member 42 extends between legs 34 at a location immediately below one of the rungs 36. Member 42 is located well above the lower ends of the legs and is provided with a wire rod 44 which extends its entire length. A pair of vertical braces 46 extend downwardly from cross member 42 at locations spaced slightly inwardly of and parallel to the respective legs 34. Only one of the braces 46 is visible in FIG. 4. Between each leg 34 and the corresponding brace 46, a vertically extending space 48 is presented.

Each leg 34 has an I-shaped extension 50 which is located within the adjacent space 48 and which is extensible and retractable therein. Each extension 50 fits rather closely in its space 48, and the opposite side edges of each extension are provided with flanges **50*a* which assist in guiding the extension and maintaining it in proper alignment as a downward continuation of its leg. As best shown in FIG. 6, the flanges 50*a* are perpendicular to the body of their extension 50 and are located adjacent opposite sides of slot 48. Flanges 50*a* overlap and engage opposite sides of legs 34 and braces 46 to prevent the extensions 50** from becoming disoriented as they are being extended or retracted.

The lowermost rung **36*a* of the ladder extends between the opposite braces 46. As best shown in FIGS. 5 and 6, a metal rod 52 extends axially through rung 36*a*. Rod 52 projects beyond the opposite ends of rung 36*a* and extends through each brace 46 and also through each of the legs 34. A fastener 52*a* is secured to each end of rod 52 and is tightened against leg 34**.

To accommodate rod 52 and to assist in maintaining proper alignment of extensions 50, each extension is provided with a slot 54. The slot 54 extend generally longitudinally of the extensions and are long enough to accommodate movement of the extensions between their extended and retracted positions. Rod 52 fits rather closely in each slot 54 and remains in the slot as the extension is moved between its extended and retracted positions.

At a location well below the lowermost rung **36*a*, aligned openings (not shown) are formed through each leg 34 and the corresponding brace 46. Each extension 50 is provided with a series of vertically spaced openings 56 wich are located below slot 54. To secure each extension 50 in place, a bolt 58 is inserted through the opening in leg 34, through an aligned opening 56 in extension 50, and through the opening of brace 46. A wing nut 60** is then threaded onto the end of the bolt.

When ladder 32 is used on a level surface, both extensions 50 are locked in their retracted position, which is the position shown for the left extension as viewed in FIG. 4. However, when used on inclined terrain such as the sloping surface 62 indicated in broken lines in FIG. 4, one of the extensions 50 is moved to an extended or partially extended position such as shown for the right extension in FIG. 4. In this position, the effective length of the right ladder leg is greater than that of the left leg. Accordingly, the ladder is able to stand uprightly with the lower ends of extensions 50 engaging surface 62. The lower end of each extension is preferably curved to enable the ladder to be tilted against an adjacent vertical surface such as an outside wall (not shown).

The flanges **50*a* of each extension engage opposite sides of legs 34 and braces 46 to prevent extensions 50 from pivoting about the axis of bolts 58. As an additional safety feature, rod 52 and slots 54 cooperate in a manner to assist in preventing the leg from becoming disoriented or misaligned. The flanges 50*a* and the cooperation between rod 52 and slot 54 also assist in maintaining extensions 50** in the proper positions as they are being extended and retracted.

In order to allow ladders 10 and 32 to be conveniently used with a conventional extension ladder (not shown) which would attach to the top of the main ladder, there is perferably an extension provided for each ladder leg. Thus, for example, ladder 10 could be employed as shown in FIG. 1 with an extension ladder to paint one side wall in the vicinity of staircase 30. Rather than simply leaning the ladder against the opposite side wall, which may not be possible due to the structure of the extension ladder, the ladder 10 is preferably rotated 180° and the positions of its extensions 20 are reversed. The ladder may then be leaned against the second wall with the extension ladder in the proper position.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A ladder comprising:

first and second legs spaced apart from one another in substantially parallel relation;

a plurality of rungs extending between said legs at spaced apart locations along their lengths;

means providing a slot adjacent the lower end of said first leg extending in a direction generally longitudinally thereof, said slot being open on opposite sides;

an extension member for said first leg having a body portion fitting in said slot and slidable therein between an extended position and a retracted position of the extension member, said extension member serving in the extended position as a downward continuation of said first leg to provide same with a greater effective length than said second leg;

releasable means for securing said extension member in its extended position; and a pair of flanges on said body portion of the extension member, said flanges being spaced apart at locations adjacent opposite sides of said slot in engagement with opposite sides of said first leg to thereby assist in maintaining the orientation of said extension member relative to said first leg.

2. A ladder as set forth in claim 1, wherein said extension member is generally in the shape of an "I" in section.

3. A ladder as set forth in claim 1, including a brace member of significantly less length than said first leg and secured at a location inwardly of and generally parallel to said first leg to present said slot between said brace member and first leg.

4. A ladder as set forth in claim 3, including a cross brace extending rigidly between said first and second legs, said brace member having a top end rigidly connected with said cross brace.

5. A ladder as set forth in claim 1, wherein said flanges extend the majority of the length of said extension member.

* * * * *